United States Patent [19]

Ritter

[11] Patent Number: 4,620,333

[45] Date of Patent: Nov. 4, 1986

[54] INCONTINENT BED FACILITY

[76] Inventor: Russell F. Ritter, 132 Concord Dr., Buffalo, N.Y. 14215

[21] Appl. No.: 735,846

[22] Filed: May 21, 1985

[51] Int. Cl.[4] ..... A61G 7/02

[52] U.S. Cl. ..... 5/90; 5/463; 269/327

[58] Field of Search ..... 5/462, 463, 468, 469, 5/90; 4/480; 269/327

[56] References Cited

U.S. PATENT DOCUMENTS

| | | | |
|---|---|---|---|
| 366,000 | 7/1887 | Holloday | 5/90 |
| 666,458 | 1/1901 | Batic | 5/463 |
| 1,097,894 | 5/1914 | Thompson | 5/463 |
| 1,341,564 | 5/1920 | King | 5/463 |
| 1,736,341 | 11/1929 | Eiser | 5/463 |
| 2,924,832 | 2/1960 | Knowles | 5/90 |
| 3,381,999 | 5/1968 | Steere, Jr. | 5/468 |
| 3,403,413 | 10/1968 | Calhoun et al. | 5/440 |
| 3,757,356 | 9/1973 | Freeman | 5/463 |
| 3,889,302 | 6/1975 | Ketterer et al. | 5/90 |
| 4,096,594 | 6/1978 | St. Jean | 5/463 |
| 4,244,066 | 1/1981 | Rukawina | 5/463 |

*Primary Examiner*—Gary L. Smith
*Assistant Examiner*—Michael F. Trettel
*Attorney, Agent, or Firm*—James J. Ralabate

[57] ABSTRACT

A liquid discharge unit having a toilet tray with drainage at the bottom of the tray. Tubing extends from this drainage to a collection vessel. The tray has an upper open surface covered by a non-corrosive nylon net. The net has above it sealed foam blocks and an outer sealed cell foam sheet to facilitate comfort to the patient and to provide a lying surface that will minimize the formation of decubitus ulcers.

18 Claims, 4 Drawing Figures

1
2
3
4
5
6
7
8
10
11
12
13

3
4
9
10
11
14
15
16
17

INCONTINENT BED FACILITY

This invention relates to a fluid discharge unit and, more specifically, to a sanitary bed pan adapted for convenient use by bedridden patients.

BACKGROUND OF THE INVENTION

Included in this invention is a comfortable mattress made primarily of convoluted polyurethane foam (although other suitable foams may be used) that incorporates a fluid discharge unit.

It is known to use various embodiments of bed pans for invalid patients in hospitals and nursing homes. There are also some devices that can be used for bedridden patients in the home but most of these are too inconvenient and unsanitary for home use. In addition, devices used in the past have done little if anything to solve the problem of bed sores or decubitus ulcers which patients develop because of their prolonged bedridden condition. These ulcers generally are the result of long stays in bed complicated by lack of adequate ventilation, residual accumulation of body fluids and deficiencies in the mattress or bed linens upon which the patient is positioned. Further, because of their long duration in bed, body or urine odors develop which make it extremely difficult to adequately care for a patient in the home.

Various therapeutic pans or devices have been used in an attempt to correct some of the above problems; typical patents disclosing these devices are U.S. Pat. Nos. 2,924,832; 3,757,356; 3,889,302 and 4,096,594. In U.S. Pat. No. 2,924,832 (Knowles) a sanitary bed is defined wherein the bed comprises an open-topped box wherein a net or gauze of flexible material is fit over this open portion. Beneath the approximate center portion of this net is positioned a drainage tray to receive the infant's or patient's urine. This tray is of stainless steel construction having suspended above it hygroscopic wicks directed downward from the net. These wicks are intended to accelerate drainage into the tray and provide for drying of the net. The nylon net and bed sheet covering in this Knowles patent device are not a soft comfortable surface. In addition, the wicks used to evaporate urine would also cause a residual odor that eventually would be discomforting to both the patient and attendants. The tray used in Knowles must be emptied from time-to-time which could cause additional discomfort to the patient. Thus, problems such as odors, bed sores, comfort, convenience of use and practicality are not solved by the device of Knowles.

In U.S. Pat. No. 3,757,356 (Freeman) a device for preventing or minimizing bed sores is disclosed. In Freeman a bed pan is defined which has a bottom section with a plurality of raised laterally spaced hollow platforms. Intermediate each platform is a space or drain channel. A perforated cover of plastic is removably placed on top of the bed pan to permit moisture and liquid to drain downward into the pan. Tubes are connected to the pan to provide vacuum exhausting of the liquids. The bed pan of Freeman rests upon the top of a bed mattress within a layer of foam. This foam has a central portion cut away to receive the bed pan. The bed pan seats into a recess around the edge of the foam so that it lies flush with the top of the foam pad. The plastic cover of Freeman lies directly over these upwardly projecting platforms and could be extremely uncomfortable to the patient. In addition, the Freeman device requires relatively expensive air and vacuum pumps that could restrict its widespread use.

The St. Jean U.S. Pat. No. 4,096,594 discloses a unit that fits between two spaced mattress sections of a bed. The channel formed by these sections has fastening members upon which a bed pan rests below the upper surface of the mattress. Extending above the channel on a plane even with the surface of the mattress sections is a mesh net. Below the net is a removable bed pan which rests upon the fastening members. The pan is pitched at a position wherein liquids collected flow toward a predetermined point at the bottom of the pan. A hose has one end coupled to this predetermined point at the bottom of the pan for draining liquids therefrom. The mesh net over the top of the channel supports the person on the mattress and permits liquids to flow therethrough. The mesh support, however, could cause severe discomfort to the patient and would not minimize the probability of decubitus ulcers.

In U.S. Pat. No. 3,889,302 (Ketterer et al) a fluid discharge unit is disclosed wherein the unit is placed on top of the mattress of a bed. This unit contains a two-dimensional array of mushroom-shaped elements that project upwardly from the floor of the device. The floor of the unit tapers inwardly to permit the accumulation of liquids to flow thereto and out of a port located at the discharge portion of the floor. The urine will flow through the interstices between the mushroom-shaped elements and out of the device via the discharge portion of the floor. The entire device of Ketterer rests on the surface of a bed and the individual rests upon its surface. This provides a resting surface that is substantially irregular and would not provide the comfort required for long term bedridden patients. In addition, the device would be relatively difficult to clean and rinse. It is therefore desirable that a device be provided that is convenient, comfortable, practical, sanitary and assist in minimizing the formation of decubitus ulcers.

SUMMARY OF THE INVENTION

It is therefore an object of this invention to provide a fluid discharge unit devoid of the above-noted disadvantages.

It is another object of this invention to provide a relatively inexpensive unit to be used to dispose of urine from bedridden patients.

Another object of this invention is to provide an effective, practical and sanitary unit to be used below the surface of a mattress and one which will provide maximum comfort for the patient.

Still another object of this invention is to provide a toilet tray unit that comprises liquid-proof components and is non-absorbent.

Another still further object of this invention is to provide a liquid-collecting unit that is adapted to be used in beds, chairs, wheelchairs or any other suitable supporting structure.

Yet another object of this invention is to provide a unit that is quick cleaning, provides substantially odor-free use and allows patient comfort and convenience.

Yet still another object of this invention is to provide a toilet unit that helps prevent the formation of decubitus ulcers in the bedridden patient.

These and other objects of this invention are accomplished generally speaking by providing a unit for use in a mattress comprising a toilet tray or collection pan, a mesh net over the open surface of the collection pan, spaced convoluted liquidproof foam pads over said net and a sealed cell foam pad containing a multitude of drain holes extending over substantially the entire area of the toilet tray. Located in the bottom portion of the four corners of the collection pan are discharge drainage ports through which the urine passes into connected tubes that lead to collection containers. From the containers the urine is disposed of without disturbing the patient or other unit elements.

The toilet tray is constructed of non-rustable material as are the other unit components. While it is preferred that the toilet tray be made from fiberglass, any other non-corrosive materials may be used such as plastics both thermo-forming and thermosetting, glass (non-fragmenting shatterproof), wood, waterproofed fabrics and other suitable materials.

The tray tapers inwardly as it approaches the flow portion. Fiberglassed into each corner of the tray is a fitting made of polyvinylchloride (PVC) or other suitable materials.

The sidewalls taper inwardly from top to bottom about five-eighths of an inch from the outer edge of the top lip. The top edge of each sidewall has a flat lip about five-sixteenths of an inch wide parallel to the tray bottom around the entire circumference of the tray.

Parallel to the length of the tray, P.V.C. fittings approximately one inch with a one-half inch opening penetrate each corner leaving one and one-half inches outside of the tray that is designed to accept flexible tubing with a one-half inch bore. The PVC fitting has a three-eighths inch bore at the outside tube attaching end. The tubing is attached with stainless steel clamps. The fittings are fitted through the bottom and sidewall of each corner in such a manner that the bottom of the fitting is lower than the bottom of the tray such that the liquid that will be entering the tray will flow by gravity into the fitting should it happen to fill that corner of the tray. Inside the tray a large hole is drilled into the fittings at tray floor level such that each fitting will drain both adjacent sides of the tray. The tubes attached to the outside of the fittings extend in a downward attitude through grommets in the bottom of the outside edge of the mattress or through the bottom of the mattress bottom proper and conduct fluids by gravity flow from the toilet tray to two self-sealing receptacles. A receptacle is placed under each side of the bed so that even though the direction of flow in the tray varies as the patient shifts his position and weight in bed and therefore depresses the mattress in such a way that the tray assumes various attitudes, flow in any direction will be accommodated and will be conducted from whatever corner is receiving the flow directly to one of the two receptacles by gravity. While dimensions are indicated in the above and below description, it is to be understood that any other dimensions that are suitable in the present invention may be used.

A double layer of nylon netting is stretched very taut over the top of the tray and is held tightly under tension by nylon drawstrings purposely woven through the nylon slightly undersize such that the nylon cover must be stretched so that the nylon drawstrings will pull in under the upper lip on the top of the sidewalls of the tray. The tighter the drawstrings are drawn the more taut and rigid the surface of the nylon net cover becomes. In some instances it may be desirable to use additional drawstrings beneath the tray from side to side or end to end to draw the circumference drawstrings even tighter and thus the nylon netting even more taut by pulling in a downward and inward manner.

The toilet tray rests on a rubber sheet which in turn lies on a one and one-half inch layer of convoluted foam through which the discharge tubing passes. The fittings are glued or caulked with a silicone compound and are placed through individually tightly fitted openings in the rubber sheet. Clamps (of stainless steel) are applied such as to make the four openings in the rubber sheet leaktight. Thus, the entire tray is within a leaktight rubber sheet that extends up to and lays out flat on the top of the mattress from the upper edge of the tray edge so that any fluids on top of the mattress on the rubber sheet will run into the tray since the patient's weight makes the toilet tray the low point of the mattress surface. The rubber sheet coming from beneath the tray covers the top of the mattress and under the toilet tray in its entirety except for about ten and one-half inches at both the head end and foot end of the mattress. The rubber sheet also extends nine inches down each side of the mattress and four and one-half inches underneath each side of the mattress. The rubber sheet is glued to the flat top edge on the top edge of the side walls of the toilet tray such that all fluids running toward the tray must enter the tray and cannot run under the tray.

Additional plies of convoluted foam are placed on top of the bottom layer of foam and the density of the foam material and the thickness of each layer can be varied depending on the size, shape and weight of the patient. Usually, the second layer would be three inches thick and of average density. As each layer of foam is added a rectangular piece is cut out precisely over the toilet tray. This cut out is made somewhat smaller as each layer is put in place such that the edge of the opening in each piece hangs over and extends into the toilet tray opening slightly further than the piece of foam immediately beneath it. In a typical unit there would be a solid bottom layer one and one-half inches thick. Then two layers each three inches thick and a final top layer one and one-half inches thick.

Usually all would be of average density. The top layer would have the smallest opening and would hang over the third layer at the tray opening. The third layer opening would hang over the second layer opening. This combination causes a slight depression in the final mattress and a smooth access from all sides into the toilet tray area.

With the toilet tray already sitting on the one and one-half inch first layer of convoluted foam at the bottom of the cut outs in the other layers, the next step is the placing of small pieces of convoluted foam approximately measuring three inches high by six inches wide by eight inches long in the opening on top of the nylon netting which is on top of the toilet tray. They are individually loosely wrapped so that the package is somewhat larger than the piece of foam inside but with the air exhausted from the surplus wrapping so as to allow space for the air that is squeezed from the foam when it is compressed. If they were tightly wrapped they would lose some of their compressibility and softness because they would become sealed bags full of air. These small pieces are sealed in liquid-proof reinforced plastic or rubberized material and are placed in such a manner that they are generally not touching each other so as to readily allow easy drainage of liquid between them. They are all placed such that their height is three inches. All convoluted foam used is polyurethane, however, other suitable foams may be used.

The total thickness of the mattress at this point is nine inches. In the toilet tray area the tray itself is one inch high with fittings and fiberglass in each corner extending down about three-eighths of an inch on a piece of convoluted foam one and one-half inches thick. Two layers of three-inch high sealed foam pieces on top of the tray nylon makes a total of eight and seven-eighths inches high in the toilet tray area. Actually using two layers of wrapped liquid-sealed foam of whatever height desired and set in various directions on top of the nylon netting makes it possible to achieve whatever height is desired. A piece of sealed cell soft flexible foam one inch thick is placed on top of the three-inch high pieces of liquid-sealed wrapped convoluted foam sitting on the nylon netting. As opposed to most products in foam, this sealed cell foam does not absorb liquids. Most foam products act essentially like a sponge. In contrast, sealed cell foam can be and is used for flotation devices. Numerous (very many) holes are punched through this last layer of foam over the toilet tray making it even softer and more flexible such that liquids readily penetrate and run through the sealed cell foam holes, in between the sealed liquid-tight convoluted foam pieces, through the nylon netting, into the toilet tray and, depending on the position of the patient, to the low end corner of the tray, through the drain fittings, down the tubes by gravity flow and into one of the two sealed lid containers under the bed.

It should be pointed out that the mattress can be widely varied depending on individual situations. One end can be more dense than the other end. In general, the mattress as a whole at nine inches depth is higher than the eight and seven-eighths or whatever desired depth at the area of the toilet tray but because the bulk of the patient's weight is borne between the headboard and tray areas it will compress that area more, so that in general the patient will be lying level except for a slight desired depression at the toilet tray area. It is planned that the rubber sheet will therefore go downhill toward this area and thereby conduct any fluid outside of the toilet tray area into the toilet tray. In some cases less foam will be used in the foot area because it bears less body weight and would therefore be higher when the patient is in bed if the amount of foam is not reduced in that area. The mattress can be customized to adjust for various problems.

When the foam and fiberglass components are assembled only liquidproof non-absorbent materials come in contact with the patient's liquid waste urine. In keeping with this thinking the entire assembled unit is slid inside a liquidproof mattress cover. An area the size of the top foam opening must be perfectly aligned and removed from the mattress top area. The rubber sheet that runs under and is attached to the tray is then pulled up through the opening and spread smoothly on the top side of the mattress to cover both sides and the surface of the mattress above and below the toilet tray area except for about ten inches at the very head of the bed and ten inches at the very foot of the bed. A small amount of the rubber sheet must be removed and cut away at each of the four corners of the toilet tray depression such that the rubber sheet can be re-cemented with waterproof glue to itself such as to remove the surplus rubber sheet material so that the remaining sheet will lay smoothly without wrinkles on the surface of the mattress.

It is important to this invention that all material used is liquid non-absorbent. The entire unit is made up basically of manmade materials that are either liquid non-absorbent or are made non-absorbent by enclosing them and protecting in some other non-absorbent material. In keeping with this plan, bedsheets are supplied that begin with an eighty percent polyester twenty percent cotton combination. They can be washed many times before being put into use and lose most of their cotton content through the multiple washings. They are also relatively loosely woven with a one hundred and twenty thread count per square inch as opposed to the standard one hundred and eighty thread count per square inch found in almost all popular brands. The reduced thread count allows fluid to rapidly pass through the sheet with virtually no or very little pooling thus keeping the patient much dryer. In addition to this the polyester threads do not absorb liquids so that the sheets dry from normal body head very rapidly.

To maintain the unit of this invention is relatively simple. The patient is rolled away from the wet spot on the mattress so that the wet spot may be washed with a cloth or brush and plain soap and water followed by a rinse with a mild antiseptic solution added and then rinsed with clear water. All of this liquid solution passes through the entire system cleansing it as it goes. Certain antiseptic products almost completely remove the urine odor from the bed and generally there is no odor in the room even after a long period of time. The wet spot on the sheet can be blow dried with a common hair dryer in three or four minutes since none of the liquid was absorbed by the polyester in the sheet. Or, the patient can be moved back over the cleansed spot which is only slightly damp at this point and will dry rapidly from body heat.

It is preferred that each unit be equipped with two or three of the sealed cell foam top pieces that are used immediately under the body areas that produce the body fluids. Having several pieces insures that a clean piece is always available when the bed is changed or cleaned. These pieces of sealed cell foam should be gently washed and gently dried in a mechanical washer and dryer to make sure that the area within the holes in the foam are kept thoroughly clean. This truly eliminates all urine odor. Removal of urine fluids by the unit of this invention keeps the patient relatively dry and relatively more comfortable. This also helps prevent decubitus ulcers.

The use of diuretics to reduce body fluids appears to be more effective when the diuretics are used in conjunction with the use of a unit of this invention. When taken at bedtime the diuretic works while the patient is in a prone position. This enables the fluids which normally pool in the legs to be more easily and thoroughly moved through the kidneys and eliminated from the body.

The combination of quick cleaning with fewer complete bed linen changings (and the related expense), the near elimination of urine odor in the bed and room, the aid in helping prevent decubitus ulcers, the simplified elimination of body fluids more effectively in the prone position while sleeping rather than spending hours on a bed pan while the diuretics are working, and just the elimination of the bed pan, to a great extent are all factors that by the use of this invention add considerable comfort and convenience to the patient's life.

DESCRIPTION OF THE DRAWING AND PREFERRED EMBODIMENTS

Figure 1:
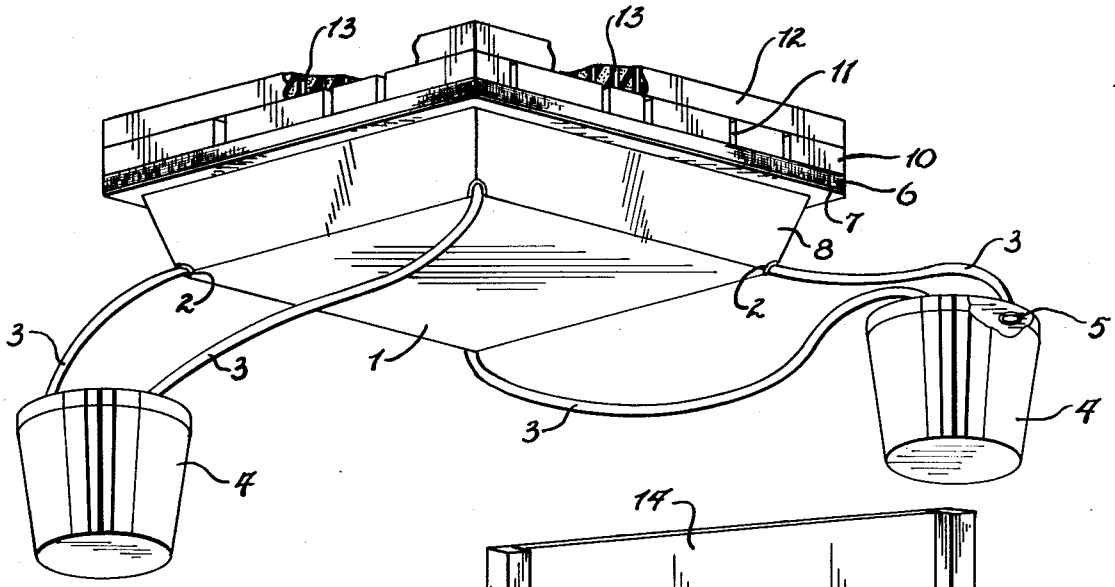
FIG. 1 is a cross-sectional view showing each of the components of the unit of this invention.

The unit of this invention provides an easily cleaned device for rapidly gathering urine released by the patient and in an expedient manner removing it from the area of the patient's body. In FIG. 1, the unit is shown having a collecting pan or vessel 1 which can be positioned in the bed or chair at a plane approximately parallel with the plane of the floor and mattress. This pan or toilet tray 1 is constructed of a non-rustable material such as fiberglass. Located at each corner of tray 1 are openings 2 into which rubber or plastic tubing 3 may be fitted. It is preferred that PVC fittings be located in each corner to facilitate substantially leakproof connection to tubing 3. However, any suitable means may be used provided each corner is accomodated with proper draining means. Tubing 3 extends from each corner opening 2 into a collection vessel 4 by gravity flow from which the urine is disposed of. Tray 1 is a conventional fiberglass tray readily available on the market. Tubing 3 is preferably nylon reinforced vinyl tubing or one-half inch ID PVC tubing available also on the market. Collection vessels 4 are commercially available plastic containers having appropriate openings 5 at the top portion to receive tubing 3. The fiberglass toilet tray 1 is covered with a double layer of nylon supporting netting 6 provided with a series of drawstrings such that the nylon cover is extremely taut over the tray and the drawstrings around the top outside are forced under a lip 7 on the top outside of the side walls that extend around the entire circumference of the tray. The side walls 8 taper inwardly from the edge of lip 7. The drain fittings 2 are situated in each of the four corners of tray 1 and are placed as indicated above through the container 1 and connected in a liquid-tight manner to tubing 3. A rubber sheet 9 (shown in FIG. 2) is positioned completely around the bottom portion of the unit having apertures through which tubing 3 is sealed liquid tight and stainless steel clamped and passes and extends into collection containers 4. Liquid-tight sealed convoluted foam blocks 10 are placed on the nylon netting 6 which is on top of the toilet tray 1. The blocks 10 are situated such that there is substantial space 11 in between them so that liquids will readily flow there between. The liquid will pass through the nylon net cover 6 and by gravity into the tray 1 and out one of the openings in the four corner drains 2 which are set in the tray such that the bottom of each drain interior is slightly below the bottom of the toilet tray 1. Convoluted foam blocks 10 are preferably made of polyurethane having the proper density. A sealed cell foam sheet 12 containing a plurality of drain holes 13 is placed on top of the liquid sealed polyurethane blocks 10 to provide a soft, comfortable surface on which the patient will lie. This sheet 12 is made from a sealed cell foam preferably Ensolite foam available from Uniroyal Company. Other sealed cell foams may be used provided that they have no detrimental effect when in contact with the skin. Typical sealed cell foams are "Armaflex", made by Armstrong Cork Company and "Neoprene", available from American Rubber Products Corporation of North Tonawanda, N.Y. Since the tray 1 drains in at least four openings 2, the patient can rest in any position even though the attitude of the tray changes its relative angle and position as the patient shifts his or her weight. The urine flow in the toilet tray 1 can pass in any direction and will be drained since the center of the tray is very slightly raised such that liquids will be inclined to drain through the openings or drains 2. Drainage is accomplished by gravity flow without any need for expensive pumps or other equipment. The unit of this invention contains component parts of sealed convoluted foam which eliminates pressure on the skin from bone protuberances thus minimizing the potential of the formation of decubitus ulcers. The unit also maintains the patient as dry as possible while providing a sanitary, comfortable reclining surface.

Figure 2:
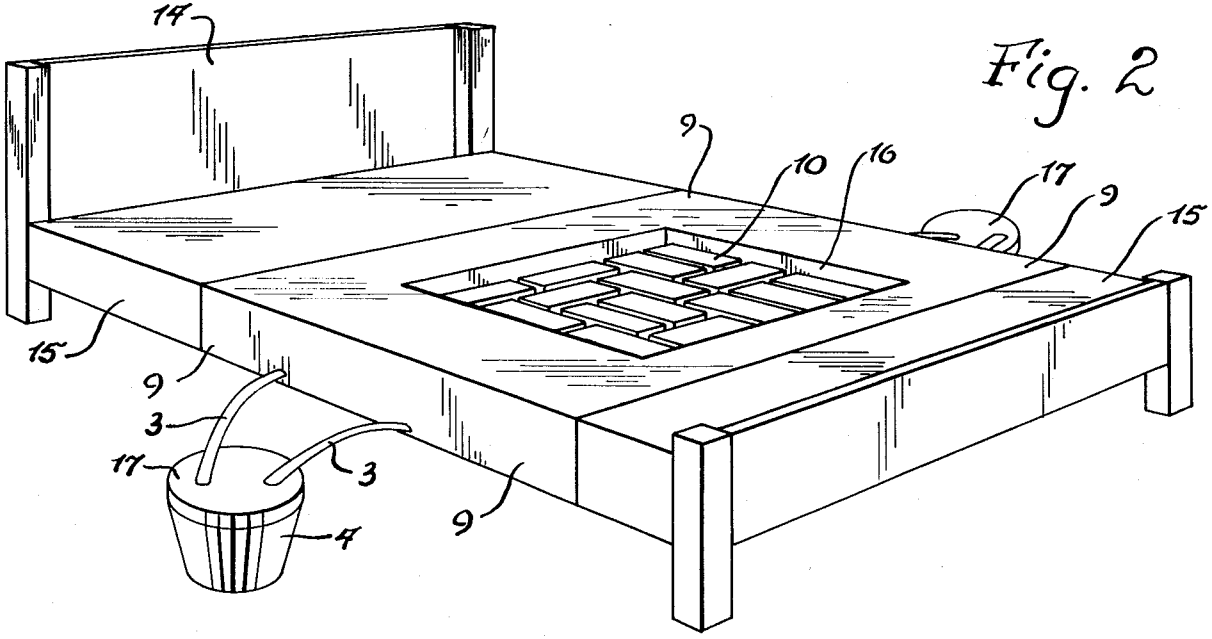
FIG. 2 is a perspective view of the unit of this invention when installed in a bed and having the upper foam layer removed.

In FIG. 2, a conventional bed 14 is shown having a mattress 15 with a cut out portion 16 to accomodate and house the unit of this invention. The mattress 15 is preferably made from convoluted foam to facilitate comfort and avoidance of bed sores. Sheet 9 is preferably a rubber sheet with cloth interior and rubber exterior available on the market today from Sears and other sources. The unit of this invention rests within opening 16 which in turn is covered with sheet 9. Sheet 9 has holes therein to allow tubes 3 to pass therethrough and extend below bed 14 to the floor on which is located collection vessels 4. In FIG. 2 foam sheet 12 is removed to illustrate the location of the unit slightly below the plane of the mattress surface. Once sealed cell foam sheet 12 is put in place, the outer surface of sealed cell foam sheet 12 will be even with the upper surface of mattress 15. As noted earlier, while the description of this unit is in connection with its use in a bed, it may be used in both conventional chairs and wheelchairs or in any other support.

Figure 3:
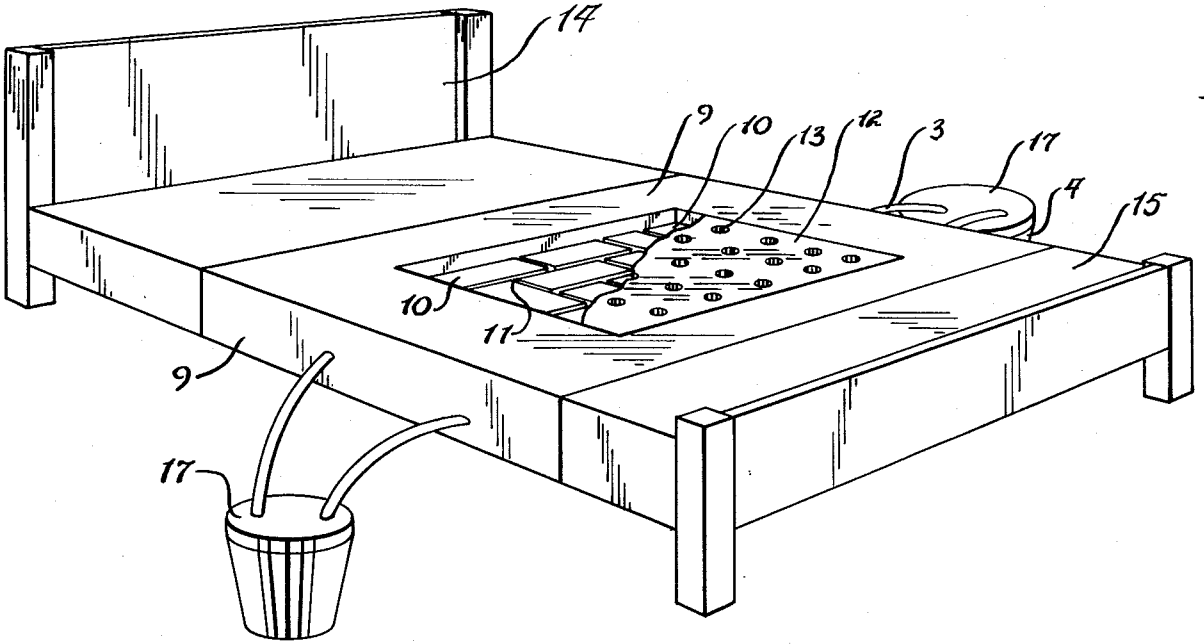
FIG. 3 is a perspective view of the unit of this invention when completely installed in a bed.

In FIG. 3, the unit of this invention is shown with foam sheet 12 in place providing a flat surface upon which the patient can lie. Blocks 10 can be seen from the cutaway portion of outer foam sheet 12. Drain holes 13 provide means for the liquid to drain through sheet 12 through spaces 11 through net 6 into container 1. From container 1 it passes through drains 2 through tubing 3 into collection vessels 4 from which it is disposed. Collection vessles 4 have a top or lid 17 which is easily removed when disposing the collected liquid.

In the present invention, the toilet tray 1 is buried near the bottom of the bed mattress which could be approximately 9 inches deep. When used in a typical hospital bed, the fiberglass toilet tray 1 uses an area approximately twenty-five and three-fourths inches of the bed width and seventeen and three-fourths inches of the bed length, and is usually thirty or thirty-one inches from the headboard. The toilet tray 1 is resting on a full twin size rubber sheet 9 which in turn is on a one and one-half inch thick layer of convoluted foam that covers almost the entire mattress 15 area. Next, two three-inch thick layers of convoluted foam are laid on the first layer and an opening for the tray area is removed from each. Finally, the top and last one and one-half inch layer of foam is cut to fit the toilet tray area and is laid on the very top. Now the entire mattress area is covered to a depth of nine inches with convoluted foam except for the toilet tray area.

Figure 4:
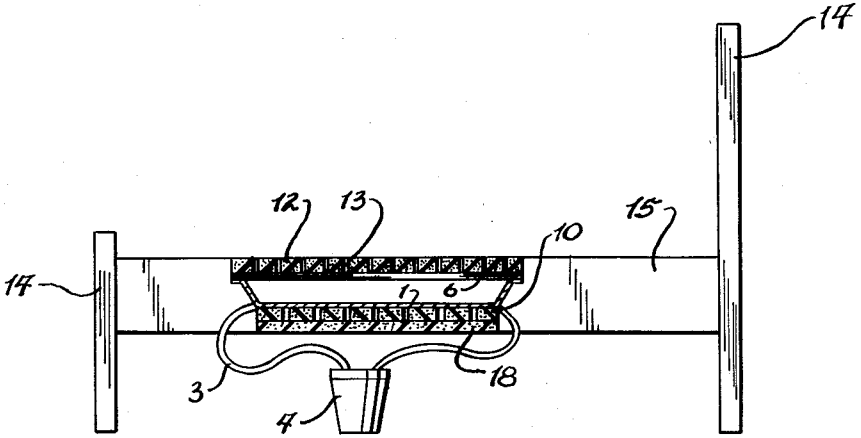
FIG. 4 is a cross-sectional view of an alternate embodiment of this invention.

It should be understood that while the above description of FIGS. 1–3 describes nylon net 6 supporting both blocks 10 and sealed cell foam sheet 12, it can be used with only sealed cell foam sheet 12 above it and blocks 10 below tray 1. This arrangement will lift the tray 1 higher in the bed and be easier to clean, since only sheet 12 need be washed; blocks 10 are not exposed to the liquid. Thus, in this arrangement, the discharge unit is more sanitary, easier to clean and provides a dryer environment. FIG. 4 shows this alternate embodiment. In FIG. 4, bed 14 is provided with a mattress 15 having a central cut out portion 16 in which is located container tray 1 having net 6 positioned above its upper end. Above net 6 is provided a sealed cell foam sheet 12 containing a plurality of drain holes 13 to accomodate flow of liquid into tray 1. Below tray 1 are positioned convoluted foam blocks 10 positioned in random arrangement below substantially the entire area of tray 1. Spaces may be provided between these blocks 10 if desired; however, since blocks 10 will not be exposed to liquid, a continuous foam sheet may be used in place of block 10. It is critical in all embodiments described herein that net 6 contact and extend over tray 1 and not be separated therefrom. It is also critical to this invention that sheet 12 be constructed from a sealed cell foam to permit flow through its apertures 13 so as not to absorb the liquid and yet be soft and comfortable. Bottom foam sheet 18 supports blocks 10 below surface of pan 1.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A liquid discharge unit comprising a toilet tray, a supporting surface and disposal means, said toilet tray comprising a top open portion and at least one opening in its lower portion, said toilet tray having positioned above said top open portion said supporting surface, said supporting surface comprising a substantially non-corrosive supporting net, said tray having said drain openings in its said lower portions which are adapted to facilitate the flow of liquid therethrough to a disposal means, positioned above and supported by said net is at least one sealed cell foam block, positioned above said block is a sealed foam sheet having apertures therein to provide conduits for liquids to pass therethrough and eventually to said disposal means.

2. The unit of claim 1 having two blocks, each of said blocks being positioned in such a manner that a space is provided therebetween for the passage of liquids.

3. The unit of claim 1 wherein said drain openings are provided with liquid-tight means from which the liquid drains into a collection vessel.

4. The unit of claim 1 wherein said tray comprises drain openings connected to flexible tubing means, said tubing means extending from said openings to a collection vessel having a removable lid portion.

5. The unit of claim 1 having three blocks of sealed convoluted foam, each block separated by a space sufficient to permit the passage of liquid therethrough, said space extending vertically from said sheet to said net.

6. The unit of claim 1 wherein said sealed cell foam sheet is liquid-sealed to prevent the absorption of liquid in the foam pores and to facilitate the passage of liquid through the apertures therein, said apertures being in flow relationship to said block spaces.

7. A liquid discharge unit comprising a toilet tray, a supporting surface, and liquid disposal means, said toilet tray comprising a top open portion and lower corner portions with openings in said lower corner portions, said toilet tray constructed of a non-metallic material and comprising in each of its said lower corner portions drain means, said tray having its top open portion substantially covered by said supporting surface, said supporting surface comprising a substantially non-corrosive supporting net which is removably attached to the top portion of said tray, positioned above said net are liquid-sealed foam blocks having spaces therebetween to permit the passage of liquid therethrough to a collection vessel positioned above said blocks is a liquid-sealed cell sheet having apertures therein to further permit the passage of liquid therethrough, said liquid disposal means comprising flexible tubes extending from said drain means to said collection vessel.

8. The unit of claim 7 having two blocks, each of said blocks being positioned in such a manner that a space is provided therebetween for the passage of liquids.

9. The unit of claim 7 wherein said drain openings are provided with liquid-tight means from which the liquid drains into a collection vessel.

10. The unit of claim 7 wherein said tray comprises drain openings connected to flexible tubing means, said tubing means extending from said openings to a collection vessel having a removable lid portion.

11. The unit of claim 7 having three blocks of sealed convoluted foam, each block separated by a space sufficient to permit the passage of liquid therethrough, said space extending vertically from said sheet to said net.

12. The unit of claim 7 wherein said sealed cell foam sheet is liquid-sealed to prevent the absorption of liquid in the foam pores and to facilitate the passage of liquid through the apertures therein, said apertures being in flow relationship to said block spaces.

13. A sanitary mattress comprising a substantially centrally located cut out portion adaptable to house a liquid discharge uit, said liquid discharge unit comprising a toilet tray, a supporting surface and disposal means, said toilet tray comprising a top open portion and lower corner portions with openings in said lower corner portions, said toilet tray having positioned above said top open portion said supporting surface, said supporting surface comprising a substantially non-corrosive supporting net, said tray having drain openings in each of its said lower corner portions which are adapted to facilitate the flow of liquid therethrough to a disposal means, positioned above and supported by said net is at least one sealed liquid tight foam block, positioned above said block is sealed cell foam sheet having apertures therein to provide conduits for liquids to pass therethrough and eventually to said disposal means.

14. The mattress of claim 13 wherein said liquid discharge unit has two liquid tight blocks, each of said blocks being positioned in such a manner that a space is provided therebetween for the passage of liquids.

15. The mattress of claim 13 wherein said drain openings are provided with liquid-tight means from which the liquid drains into a collection vessel.

16. The mattress of claim 13 wherein said tray comprises drain openings connected to flexible tubing means, said tubing means extending from said openings to a collection vessel having a removable lid portion.

17. The mattress of claim 13 having three blocks of sealed liquid tight convoluted foam, each block separated by a space sufficient to permit the passage of liquid therethrough, said space extending vertically from said sealed cell foam sheet to said net.

18. The mattress of claim 13 wherein said sealed cell foam sheet is liquid-sealed to prevent the absorption of liquid in the foam pores and to facilitate the passage of liquid through the apertures therein, said apertures being in flow relationship to said block spaces.

* * * * *